US008888027B2

(12) United States Patent
Trembley et al.

(10) Patent No.: US 8,888,027 B2
(45) Date of Patent: Nov. 18, 2014

(54) CONICAL IMPACT MILL

(75) Inventors: Jean-Philippe Trembley, Surrey (GB); Neil Robert Hansford, Somerset (GB)

(73) Assignee: Air Products and Chemicals, Inc., Allentown, PA (US)

( * ) Notice: Subject to any disclaimer, the term of this patent is extended or adjusted under 35 U.S.C. 154(b) by 161 days.

(21) Appl. No.: 13/640,566

(22) PCT Filed: Apr. 8, 2011

(86) PCT No.: PCT/EP2011/055559

§ 371 (c)(1), (2), (4) Date: Oct. 11, 2012

(87) PCT Pub. No.: WO2011/128274

PCT Pub. Date: Oct. 20, 2011

(65) Prior Publication Data

US 2013/0026271 A1 Jan. 31, 2013

(30) Foreign Application Priority Data

Apr. 14, 2010 (EP) ..... 10159959

(51) Int. Cl.

| | |
|---|---|
| ***B02C 13/26*** | (2006.01) |
| ***B02C 13/28*** | (2006.01) |
| *B02C 13/14* | (2006.01) |

(52) U.S. Cl.

CPC ..... *B02C 13/14* (2013.01); *B02C 2013/145* (2013.01); *B02C 13/2804* (2013.01)

USPC ..... 241/27; 241/261.1; 241/275; 241/286

(58) Field of Classification Search

USPC ..... 41/275, 286, 30, 27; 241/275, 286, 30, 241/27, 261.1

See application file for complete search history.

(56) References Cited

U.S. PATENT DOCUMENTS

| | | | |
|---|---|---|---|
| 2,752,097 | A | 6/1956 | Lecher |
| 3,071,330 | A | 1/1963 | Jackering |
| 2008/0245913 | A1 | 10/2008 | Waznys |

FOREIGN PATENT DOCUMENTS

| | | | |
|---|---|---|---|
| CN | 201404825 | Y | 2/2010 |
| CN | 101687196 | A | 3/2010 |
| DE | 10053946 | C2 | 8/2002 |
| DE | 20211899 | U1 | 9/2002 |
| DE | 102005020441 | A1 | 11/2006 |
| EP | 0605169 | A1 | 6/1964 |
| EP | 0605169 | A1 | 7/1994 |
| EP | 0696475 | A1 | 2/1996 |
| WO | 2006117065 | A1 | 11/2006 |

OTHER PUBLICATIONS

European Patent Office, International Search Report prepared for PCT/EP2011/055559, mailed on Jul. 26, 2011.

*Primary Examiner* — Mark Rosenbaum

(74) *Attorney, Agent, or Firm* — Larry S. Zelson; Eric J. Schaal

(57) ABSTRACT

A conical impact mill has a rotor assembly (1) in which impact elements (7) arranged in at least two axially spaced rows provide, or can be adjusted to provide, a grinding gap (a', a"), defined between the impact elements and a right frusto-conical grinding surface of the mill housing (2), that is not constant in the axial and/or circumferential direction of the rotor assembly. Impact elements can be fixedly or adjustably mounted in the rotor assembly and/or the rows can be mutually adjustable axially to change the grinding gap.

15 Claims, 18 Drawing Sheets

CONICAL IMPACT MILL

The present invention relates to conical impact mills.

Conical impact mills are well known in the art and comprise a rotor assembly mounted for rotation in a tubular housing having a right frustoconical grinding surface coaxially aligned with the rotor assembly, the rotor assembly having at least two axially spaced rows each of circumferentially spaced impact elements to define an annular grinding gap between the impact elements and the grinding surface. The housing has an inlet for feed to be comminuted in the mill and an outlet for comminuted feed.

Conical impact mills rely upon the rotational speed of the impact elements to provide a centrifugal force whereby circumferentially accelerated particles constrained in the grinding gap are comminuted by impact, attrition and particle-particle collision (often referred to as jet milling effect). The mills are of particularly use for comminuting tough and hard materials that are otherwise difficult to reduce in size. Sticky, elastic and heat-sensitive materials are also able to be comminuted in such a device in combination with cryogenic cooling. In particular, conical impact mills are particularly suited for comminuting materials such as, for example, plastics, rubbers, elastomers, foods and spices, paint pigments, metals, coated plastics, electronic waste, and foams by making them brittle by cooling to temperatures below the respective glass transition temperature, especially to cryogenic temperatures.

Amorphism is a phenomenon of materials where there is no long-range order of the molecules within the compound. Amorphous materials exist in two distinct states, "rubbery" or "glassy". Amorphism is the basis for cryogenic grinding as applied in most industrial environments today. This behaviour can be observed from the thermal scan of an instrument such as the Differential Scanning calorimeter (DSC). The DSC identifies, among other properties of the material, the temperature where the material transitions between the glassy and rubbery states, commonly known as the glass transition temperature (Tg). The purpose of the cryogenic fluid in dry milling is therefore to maintain the temperature below the glass transition temperature, or in the "glassy" state, where the material is brittle and prone to disintegration.

At room temperature, hammering a piece of glass will break it, while hammering a piece of rubber will not. The rubber would simply absorb the energy by momentarily deforming or stretching. However, if the same piece of rubber is submerged in liquid nitrogen (LIN), it will behave like brittle glass—easy to shatter with a hammer. This is because LIN-cooled rubber is below its Tg.

The term ambient grinding, as used in this context, applies to systems where the starting material is fed to the grinding mill at or slightly below ambient temperature. In the case of cryogenic grinding, the starting material temperature is substantially reduced at least to −80° C. immediately prior to grinding.

U.S. Pat. No. 2,752,097 discloses a cylindrical impact mill in which the rotor has discs (52, 54) on which radially extending circumferentially spaced blades (45, 47, 49) are mounted. The discs, but not the blades, vibrate to provide a gaseous fluid sonic energy of at least 120 decibels. In the embodiment of FIG. 13, the radial spacing between the blades (71 to 79) increases upwardly and downwardly of an intermediate stage (74) so as to provide, in the direction of fluid flow, a convergent-divergent grinding gap. The elastic modulus and disc thickness at successive stages is varied (see column 10, lines 44/46) and it appears that the rationale for the shape of the gap is concerned with the vibratory aspect of the mill.

U.S. Pat. No. 3,071,330 discloses a cylindrical impact mill in which impact elements (11) are adjustably mounted to change the grinding gap (see column 3, lines 19/31). However, there does not appear to be any disclosure of adjusting the elements so as to provide a non-uniform grinding gap. DE-A-10 2005 020441 discloses a cylindrical impact mill in which there are vertical stacks (40) of impact elements (60) adjustably mounted in brackets (50) so that the extent to which they extend from the holders (37) can be varied (see #0040).

EP-A-0696475 discloses a cylindrical impact mill having a ring-form rotary hammer (14) having a pulverizing blade with a plurality of concaves and convexes opposing a liner also having concaves and convexes. In the embodiment of FIG. 11, the convexes (17, 17') alternate in size so that the grinding gap is circumferentially non-uniform.

Conical impact mills have been known since at least 1975 (see DE-A-2353907) and significant improvements and modifications have been reported in recent years (see, for example, EP-A-0787528; DE-A-100 53 946; DE-A-202 11 899 U1; US-A-2006/0086838; US-A-2008/0245913 & US-A-2009/0134257). In particular, DE-A-202 11 899 U1 discloses a conical impact mill in which impact elements (34) are peripherally spaced at 30 to 50 mm intervals. The grinding gap can be adjusted by the use of spacers (66) to change the relative axial positions of the rotor assembly (14) and the grinding surface (64). Reference is made to reversing the axial mounting of worn elements by moving them from one surface to the other surface of their supporting disc (30, 32).

The extent of commutation provided by a conical impact mill is dependent on inter alia the radial dimension of the grinding gap. To the best of the Inventors' knowledge and belief, it is a common feature of all prior art conical impact mills that the radial dimension is constant in both the circumferential and axial directions. The gap can be changed, for all rows, by replacing one rotor assembly with another in which there is a different radial spacing of the outer edge of the impact elements from the rotor axis and/or by changing the relative axial positions of the rotor assembly and the grinding surface (as illustrated by comparing present FIGS. 2A & 2B). However, adjustment by changing the relative axial positions has limitations because constructional constraints, alignment, material manufacturing techniques and normal manufacturing tolerances associated with cast components make it difficult to accurately set the gap size and/or match the gap size to the size reduction required when it is required to change feed material or throughput.

An object of the present invention is to improve the efficiency of conical impact mills both in terms of provision of the required degree of communication and ease of adjustment to compensate for impact element wear and changes in feed material properties.

The present invention provides a conical impact mill comprising a rotor assembly mounted for rotation in a tubular housing having a right frustoconical grinding surface coaxially aligned with the rotor assembly, the rotor assembly having at least two axially spaced rows each of circumferentially spaced impact elements defining an annular grinding gap between the impact elements and the grinding surface, and the housing having an inlet for feed to be comminuted in the mill and an outlet for comminuted feed, characterised in that the impact elements provide, or are adjustable to provide, a grinding gap in which the radial dimension is not constant in one or both of the axial and circumferential directions.

According to one preferred embodiment, the radial dimension of the grinding gap between the respective rows of impact elements and the grinding surface is constant in the circumferential direction but the radial dimension of the grinding gap between at least one row and the grinding surface is different from that between at least one other row and the grinding surface.

In another preferred embodiment, at least one row of impact element is axially movable relative to at least one other row of impact element whereby the relative radial dimensions of the grinding gap between said rows and the grinding surface can be changed.

In a further preferred embodiment, at least one impact element is adjustable relative to the rotor axis of rotation to change the radial dimension of the grinding gap between the impact element and the grinding surface. Usually, all impact elements in at least one row, preferably all rows, are adjustable in this manner.

The aforementioned preferred embodiments are not mutually exclusive and conical impact mills of the invention can incorporate features from more than one of said embodiments.

The grinding gap between the impact elements of a row can be constant in the circumferential direction of the rotor assembly or can vary in that direction. Usually, each impact element in a row will extend to the same radial extent, whereby the grinding gap is circumferentially uniform about the row. However, one of more impact elements in the row can extend to a different radial extent than others, whereby the grinding gap varies in the circumferential direction of the row. For example, alternate impact elements can extend to the same radial extent but different from the intervening impact elements, whereby radially narrower grinding gaps alternating with wider grinding gaps.

The grinding gaps between the impact elements of one row and the grinding surface can, and in relevant embodiments will, differ from the grinding gaps of one or more other rows. Usually, and especially when there is respective circumferential uniformity of the grinding gap provided by the rows, the grinding gap will progressively increase or, preferably, decrease row by row in the axial direction from the feed inlet to the comminuted feed outlet. However, other arrangements such as alternating narrower and wider gaps can be used.

The frustoconical grinding surface can be axially adjustable with respect to the rotor assembly, for example as known in the art, to simultaneously change the grinding gap radial dimension for all rows.

The grinding surface can be profiled, for example as known in the art, with, for example, axially extending or inclined groves, to enhance comminution on particle impact.

The rotor assembly can be of a type known in the prior art. In one embodiment, it comprises a solid or hollow, usually cylindrical, rotor having axially spaced circumferentially extending flanges on which the impact elements are mounted. In another embodiment, the rotor comprises circular discs mounted at axially spaced locations on a common shaft. At least some of the discs can be selectively secured at two or more axially spaced locations, whereby the axial distance from adjacent discs can be changed, and/or the discs can be releasably mounted on the shaft so that one or more discs can be replaced by new discs and any remaining discs can be replaced for continuing use.

At least some of the impact elements in at least one row can be mounted for selective radial location, relative to the rotor axis, in order to change the extent to which the outer edge of the impact element is spaced from the axis. Such adjustment can be provided by, for example, provision for radial adjustment of the mounting of the impact element on the rotor by adjustable fixing means. Said means can comprise, for example, a bolt or other fixing member passing through a radially elongate hole in one of a base of the impact element and the rotor flange or disc on which the impact element is mounted and a co-operating hole in the other thereof. Multiple fixing holes can be provided instead of the elongate slot. Wedge-shaped profiles can be provided at circumferentially spaced locations on the rotor disc or flange in order to constrain adjustable movement of the impact elements in the radial direction. In an alternative arrangement to the use of an axially extending bolt or other fixing member, adjustment of the impact elements can be provided by fixing means, such as an adjustable screw, acting between adjacent impact elements to clamp them to respective sides of the wedge-shaped profile. In a further alternative, serrated profiles can be provided between the wedge-shaped elements to permit incremental radial adjustment. In its broadest aspect, the invention is not restricted to any particular means of providing for impact element adjustment and other means of adjustment than those described above will be apparent to those skilled in the art.

In some embodiments of the invention, it is unnecessary for the impact elements to be adjustably mounted on the rotor. The entire rotor assembly or, when present, one or more removable discs can be replaced by a different rotor assembly or disc in which fixed impact elements provide the required change in grinding gap dimension. Such an arrangement may include additional cost for providing a required range of rotors or discs, less flexibility in terms of gap adjustment, and an inability to compensate for uneven impact element wear.

The impact elements can be provided individually or in pairs or multiples spaced apart on a common base. Further, the impact elements can extend axially in conventional manner but alternatively can be inclined relative to a plane containing the rotor axis.

Each rotor disc or flange can carry one row of impact elements mounted on one surface and a second row of impact elements mounted on the opposed surface.

The following is a description by way of example only and with reference to the accompanying drawings of presently preferred embodiments of the invention.

In the drawings:—

Figure 2A:
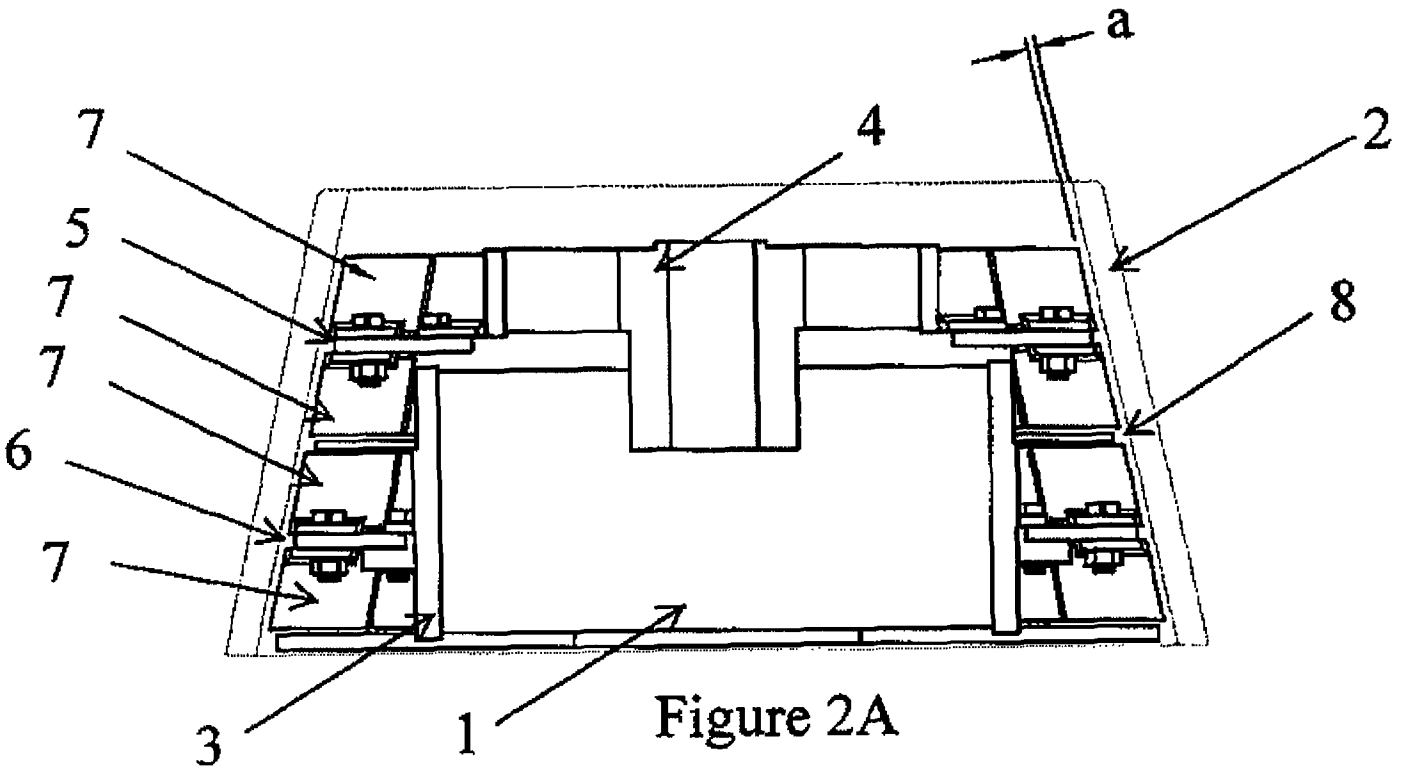
FIG. 2A is an axial cross section of the rotor assembly of a conventional conical impact mill.
Figure 2B:
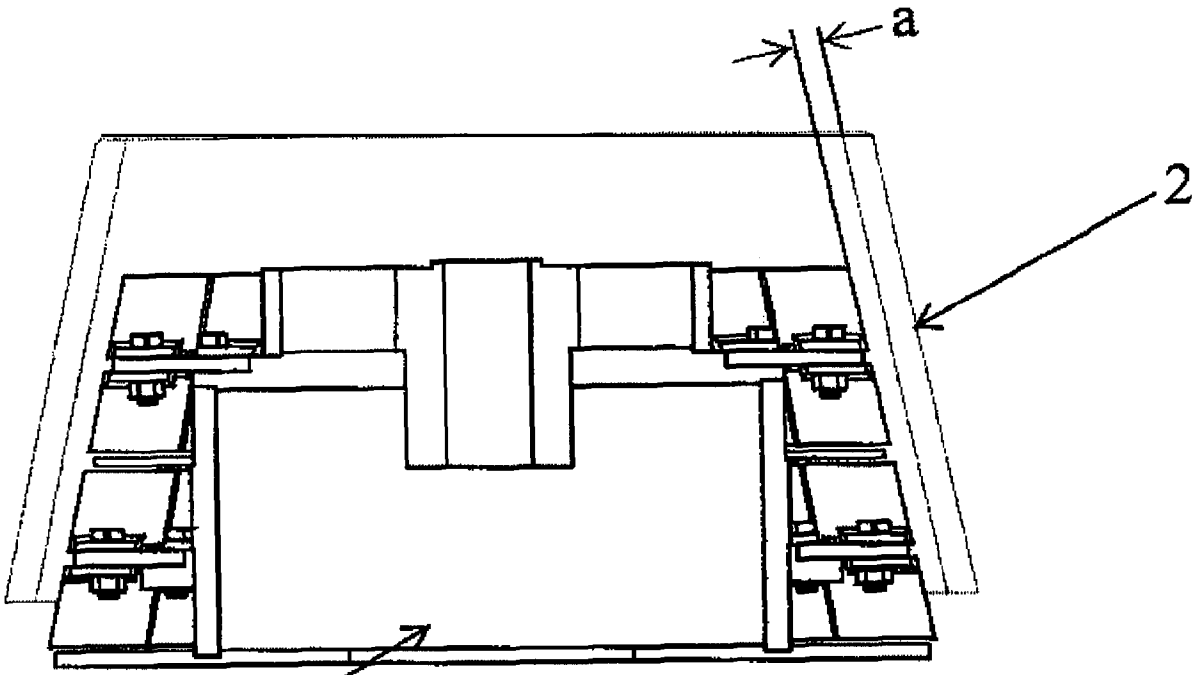
Figure 3A:
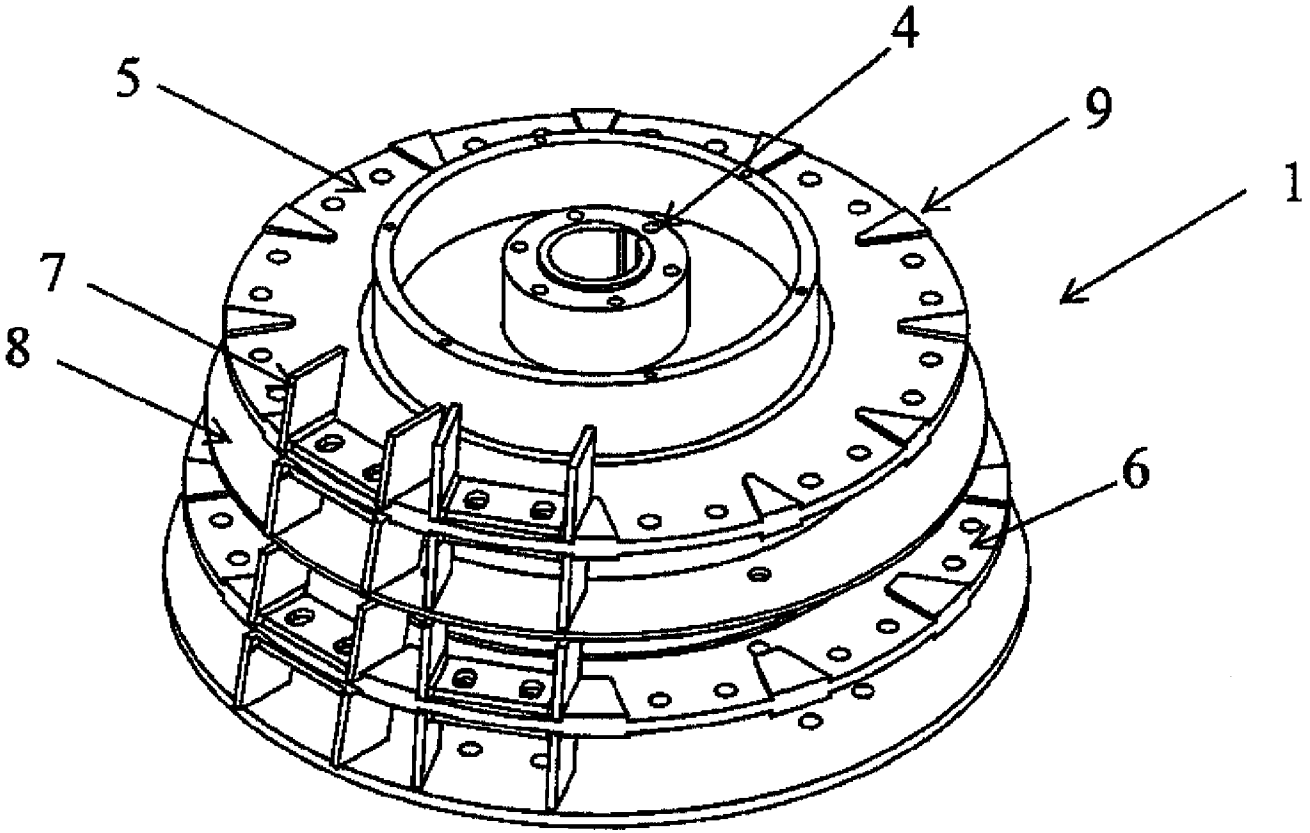
Figure 3B:
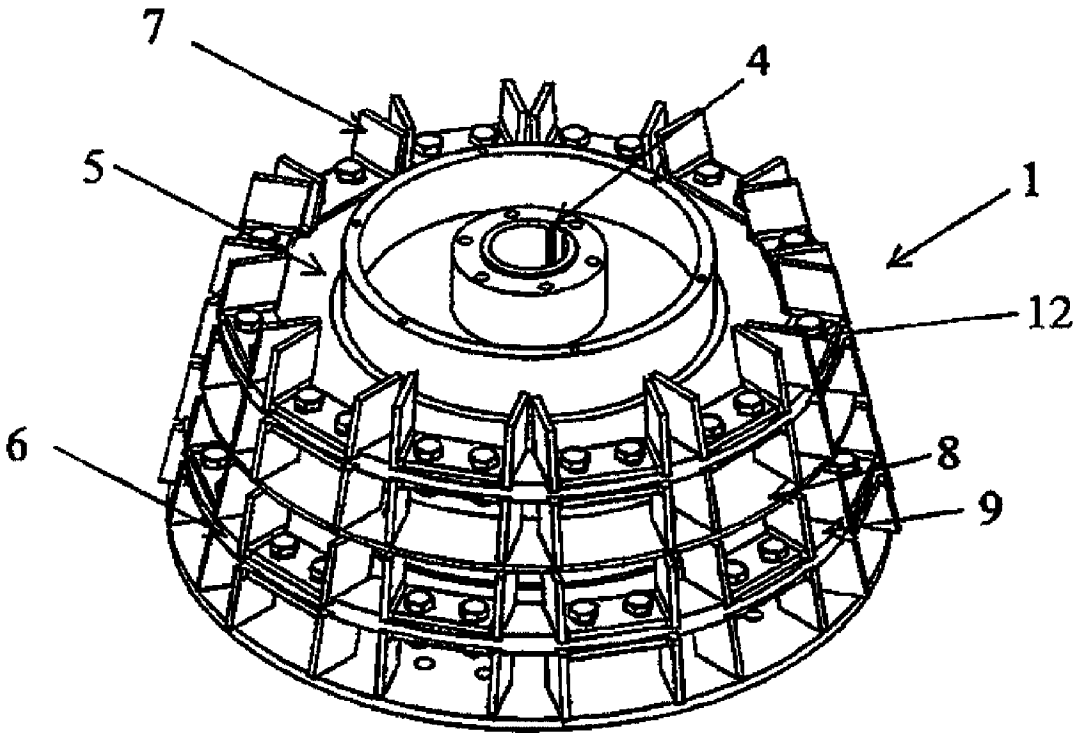
Figure 3C:
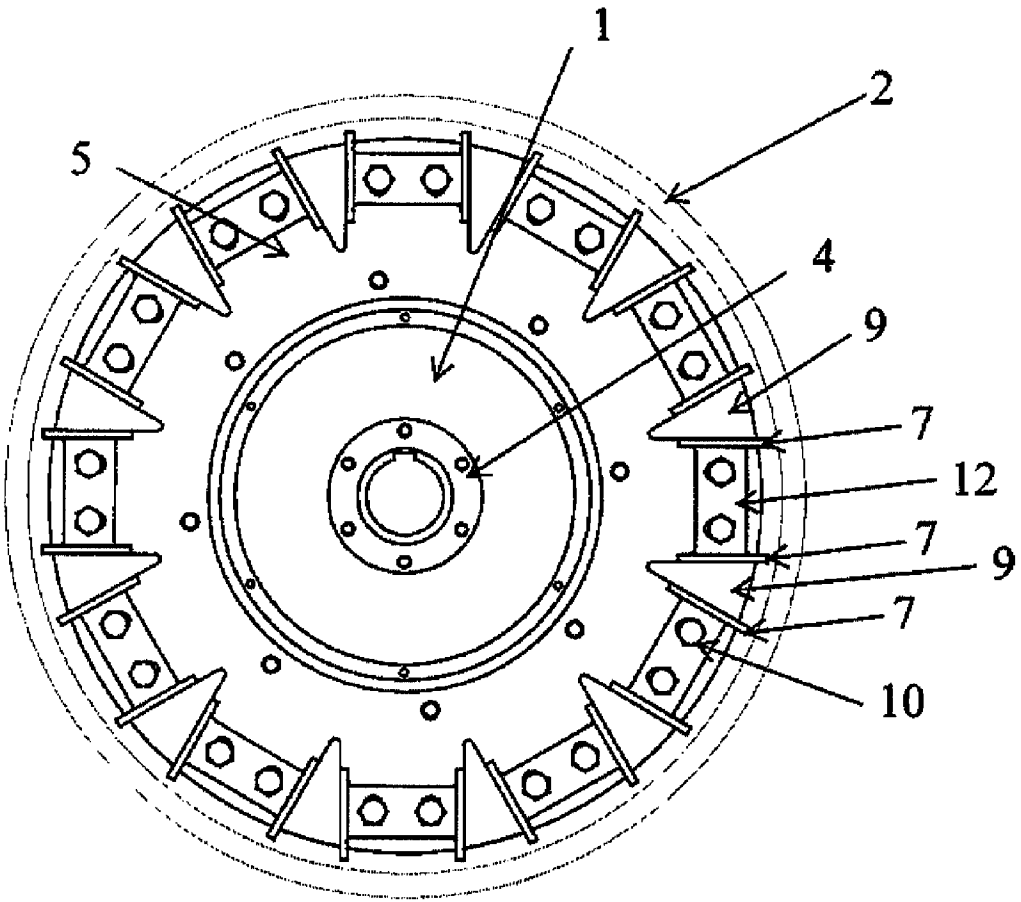
Figure 4A:
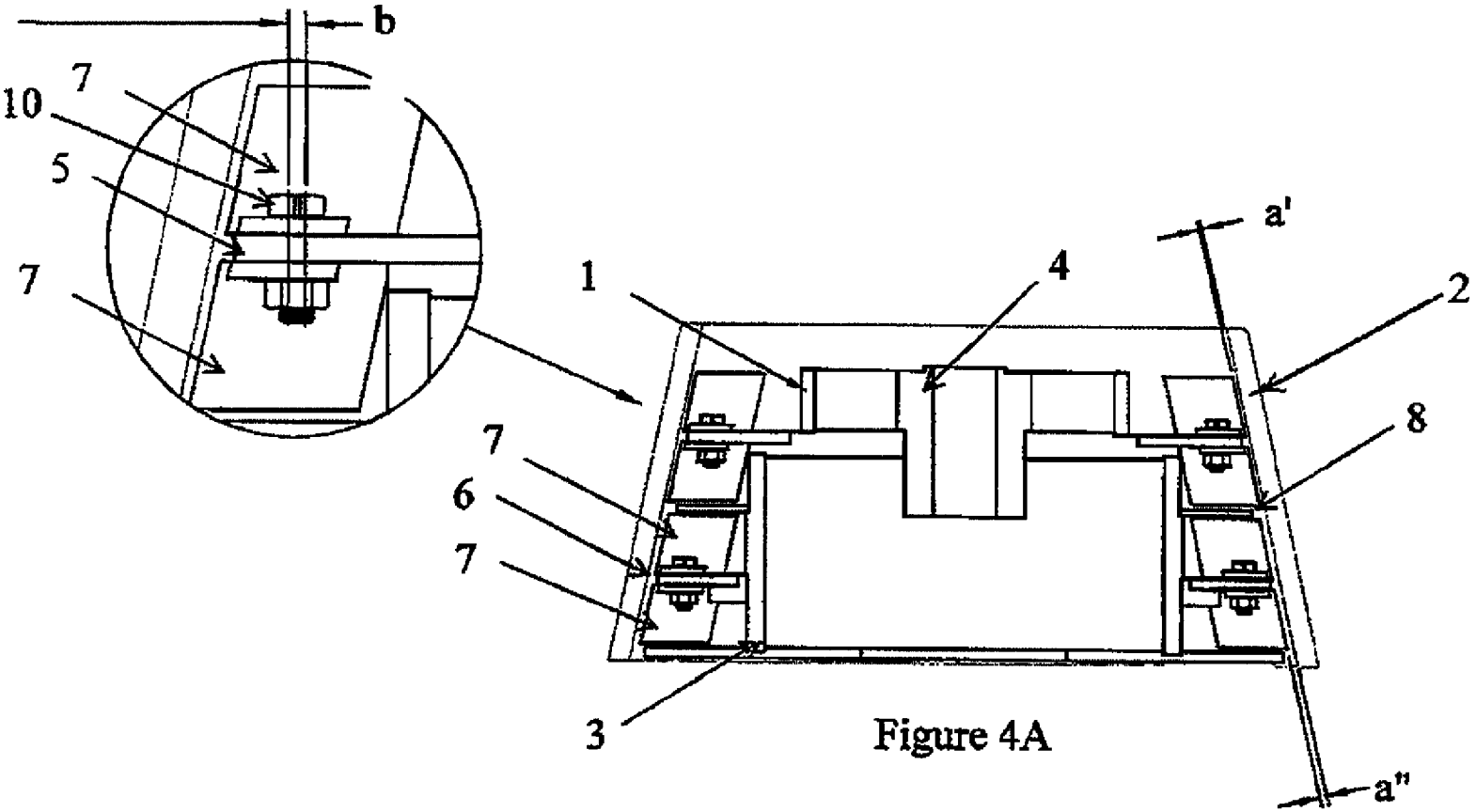
Figure 4B:
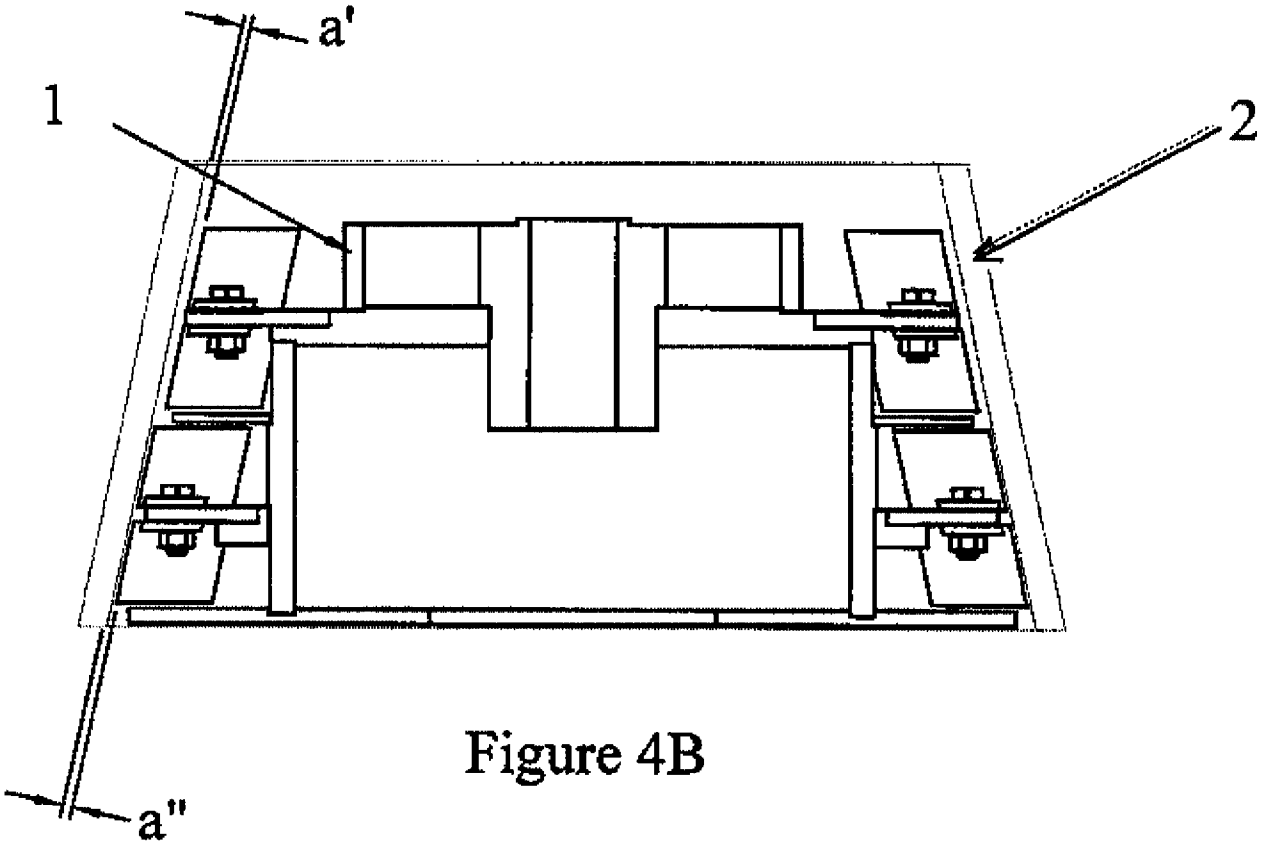
Figure 5A:
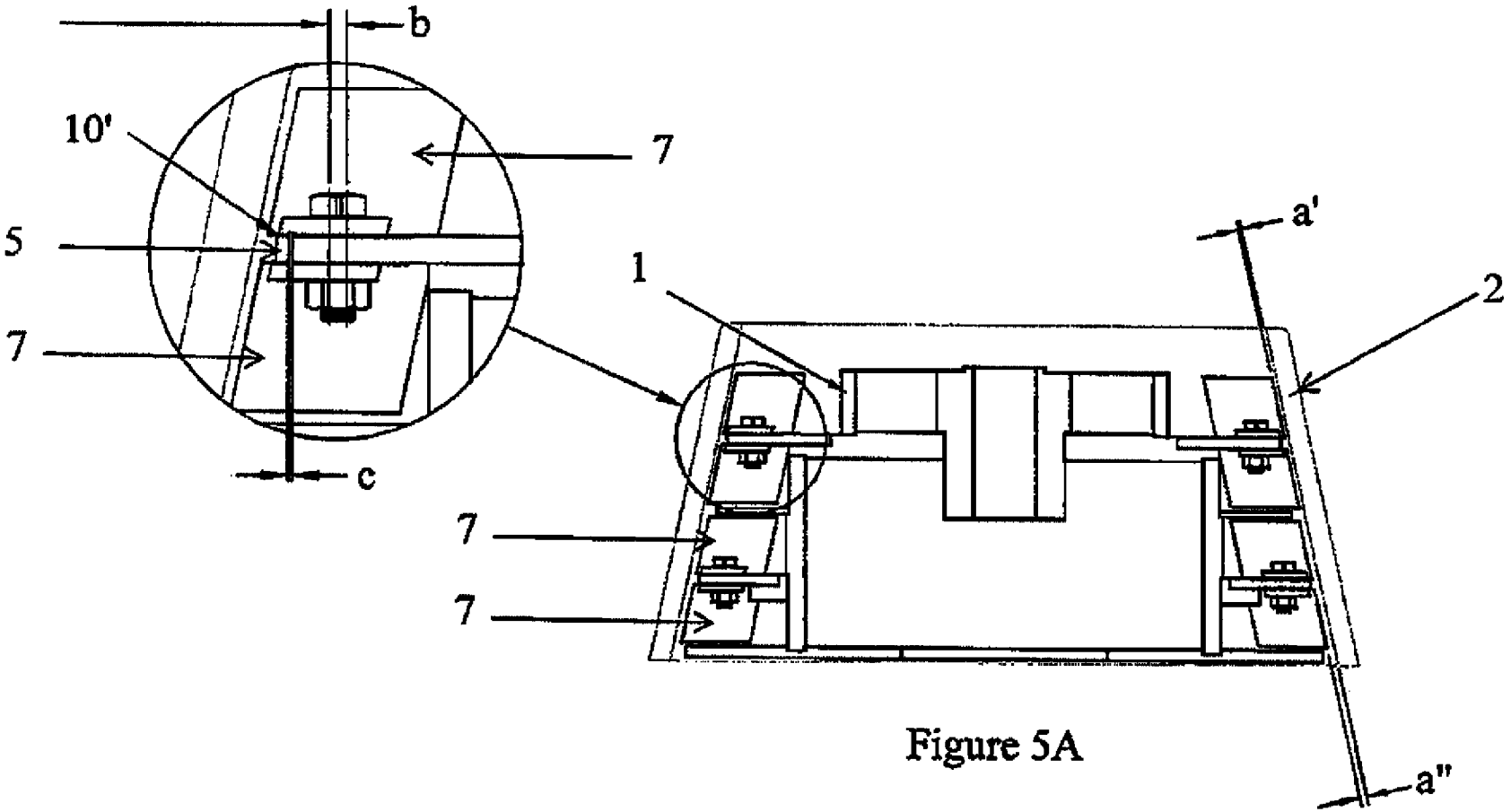
Figure 5B:
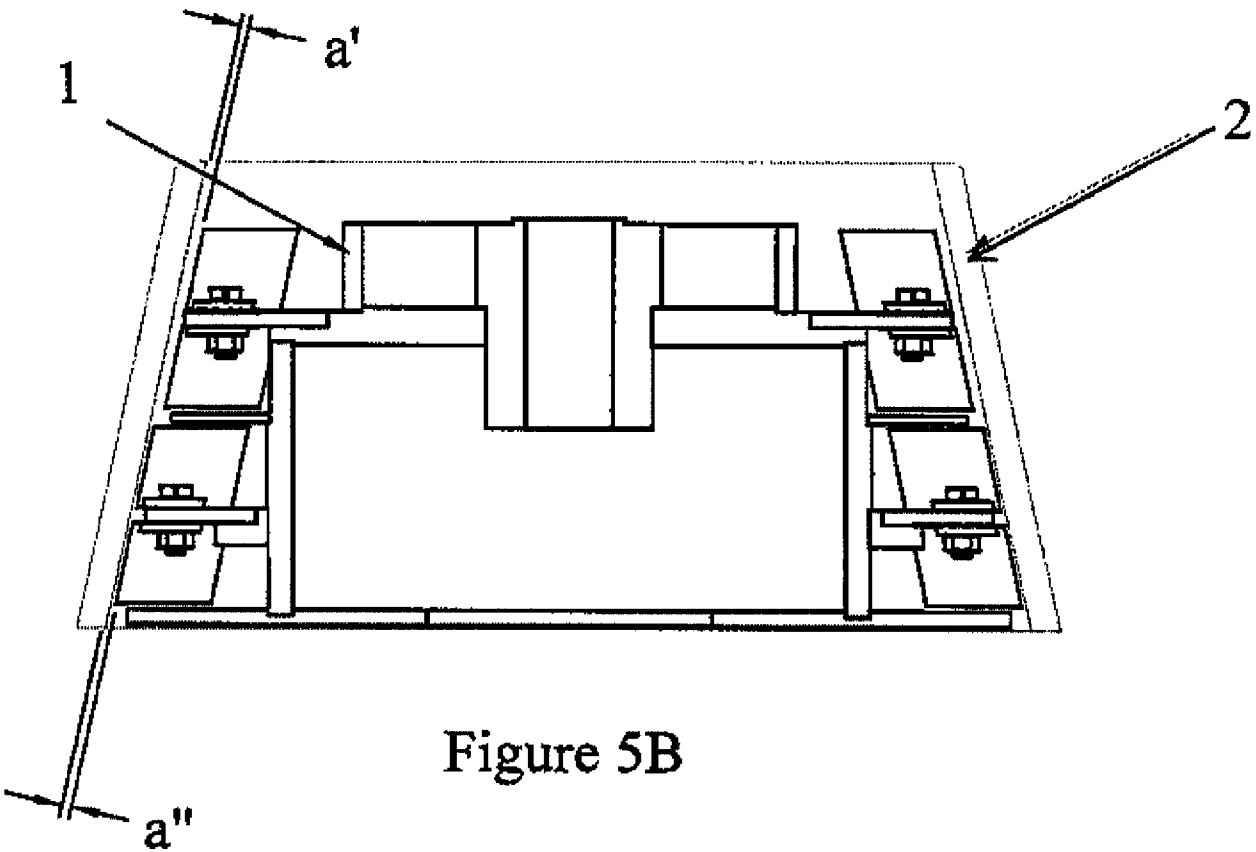
Figure 5C:
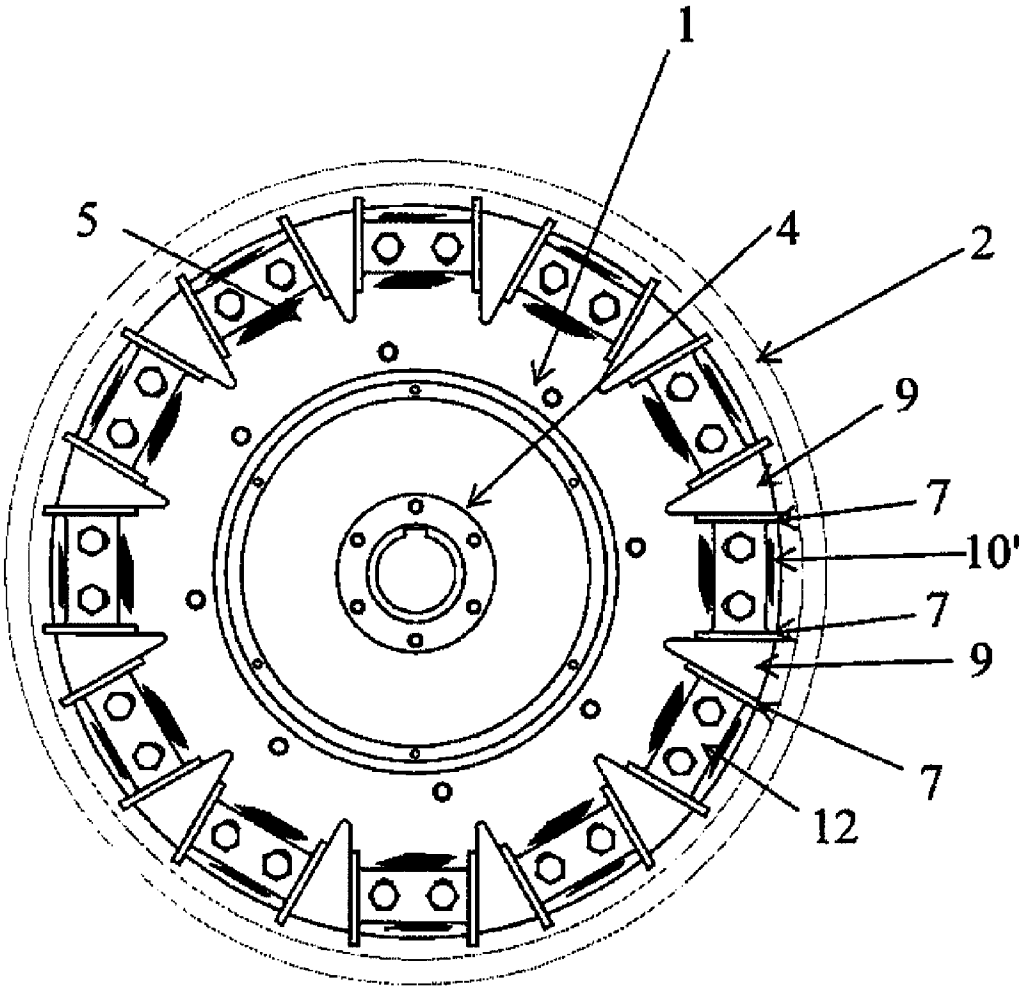
Figure 6A:
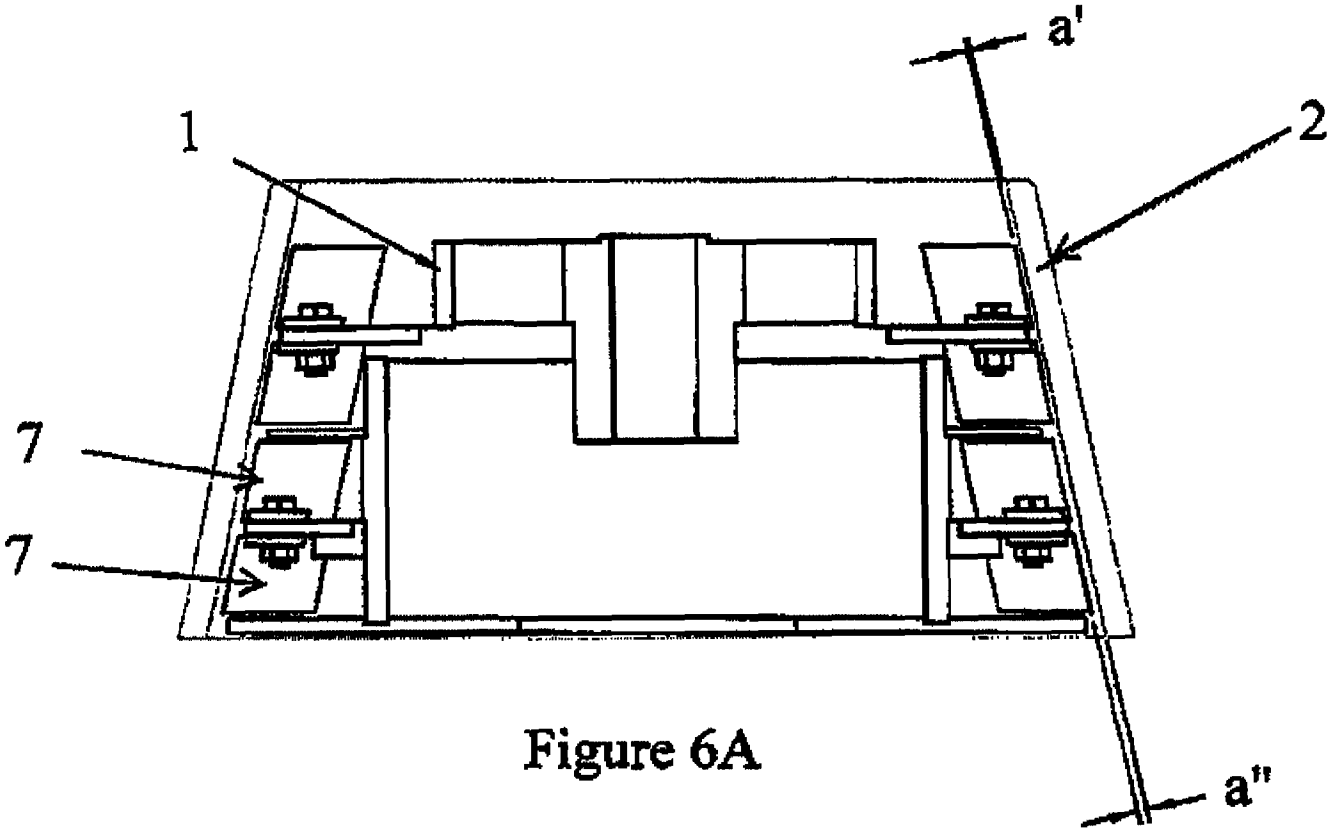
Figure 6B:
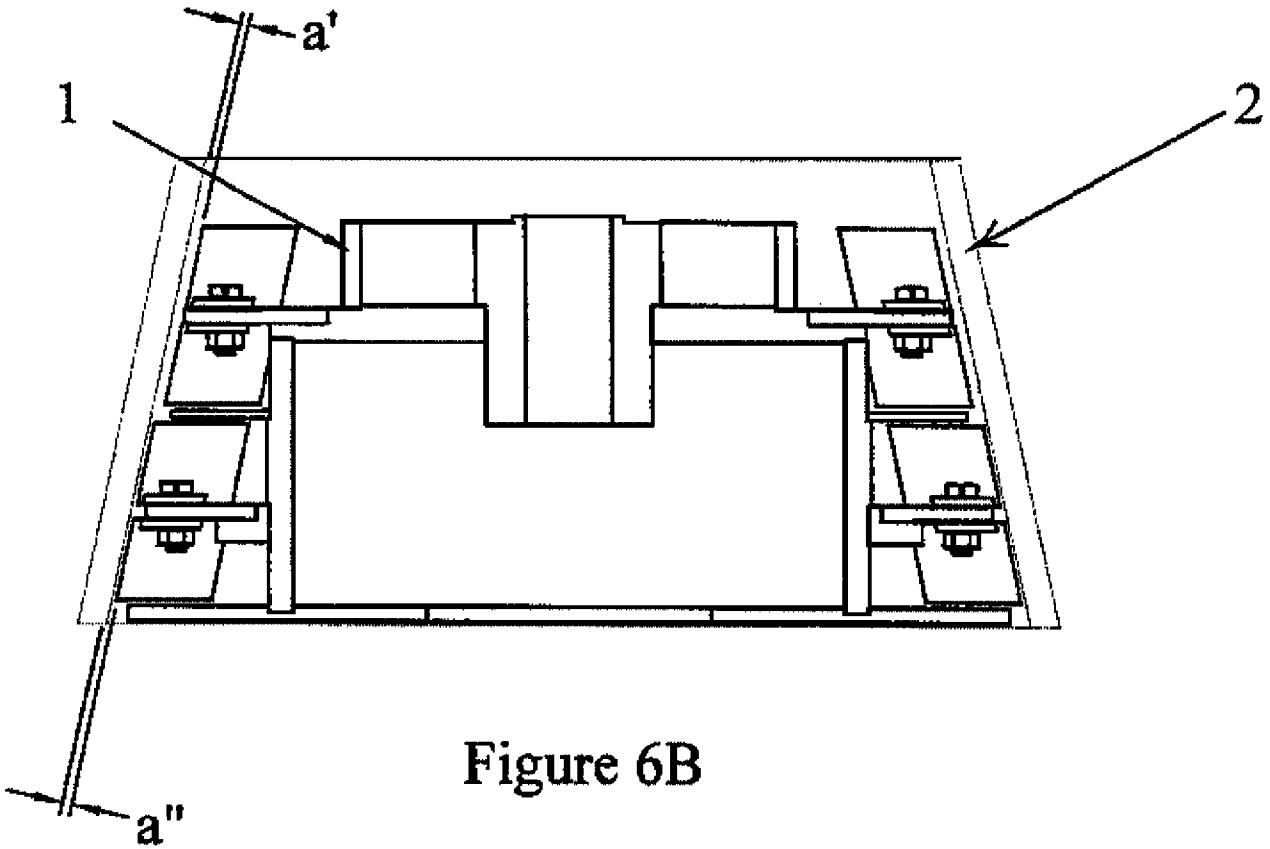
Figure 6C:
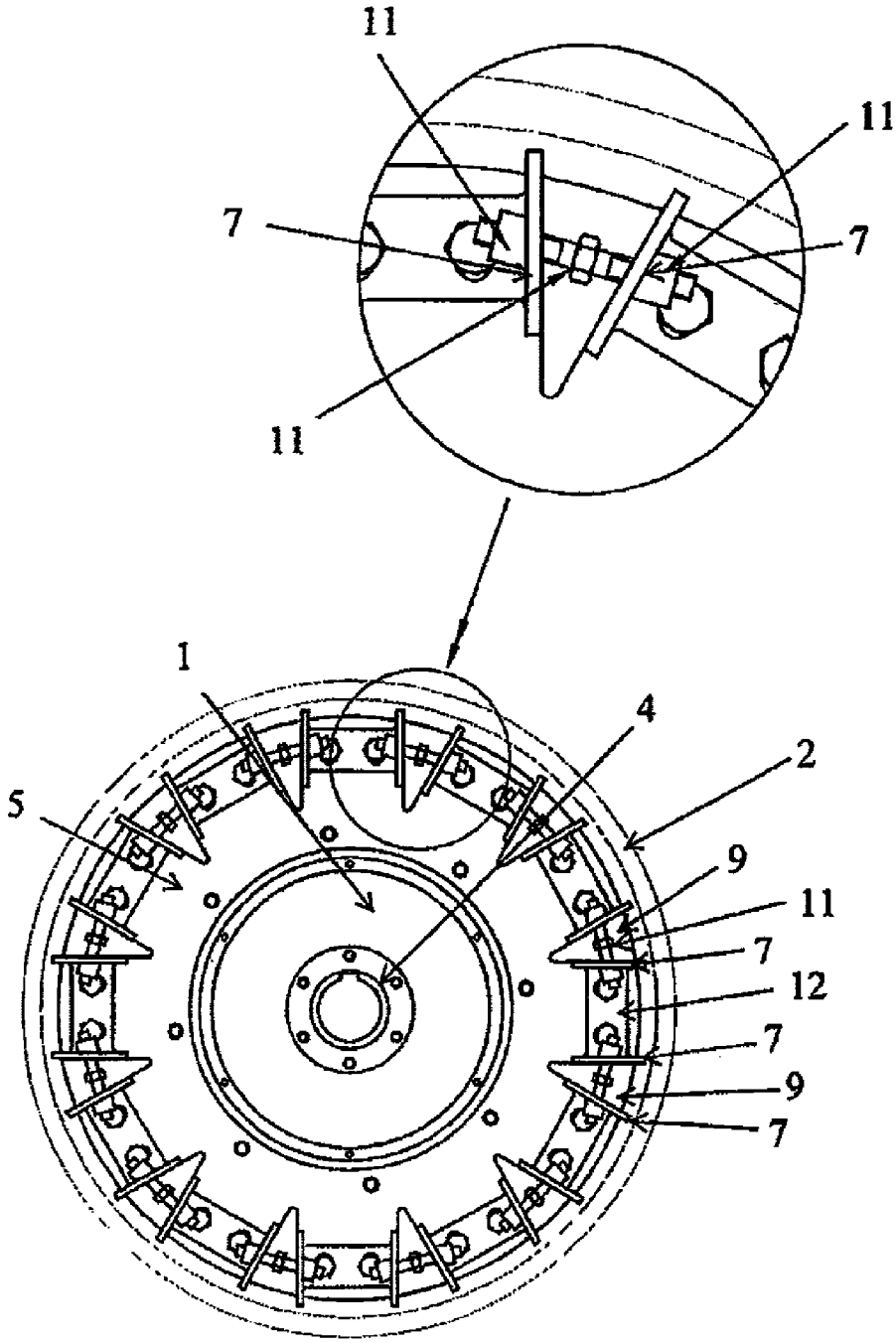
Figure 7:
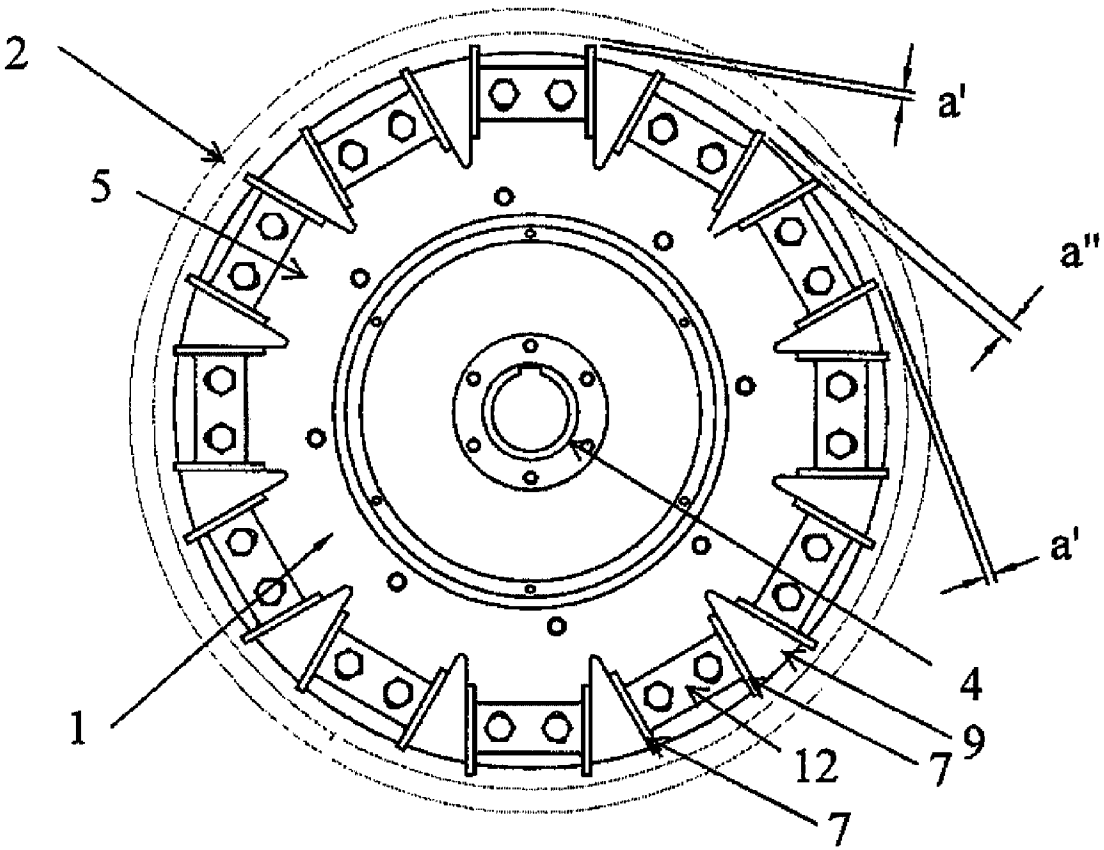
Figure 8C:
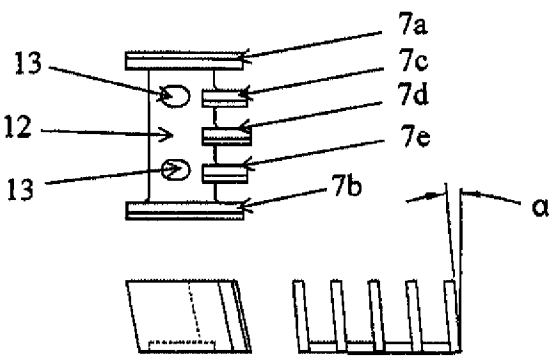
Figure 8B:
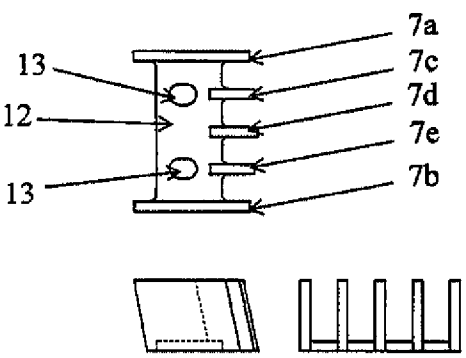
Figure 8A:
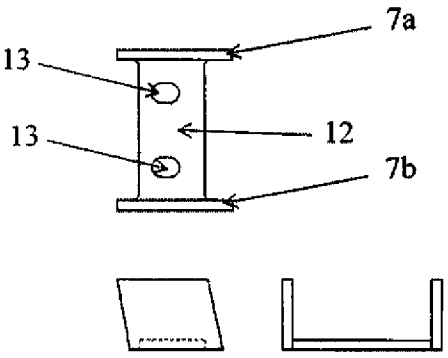
Figure 9A:
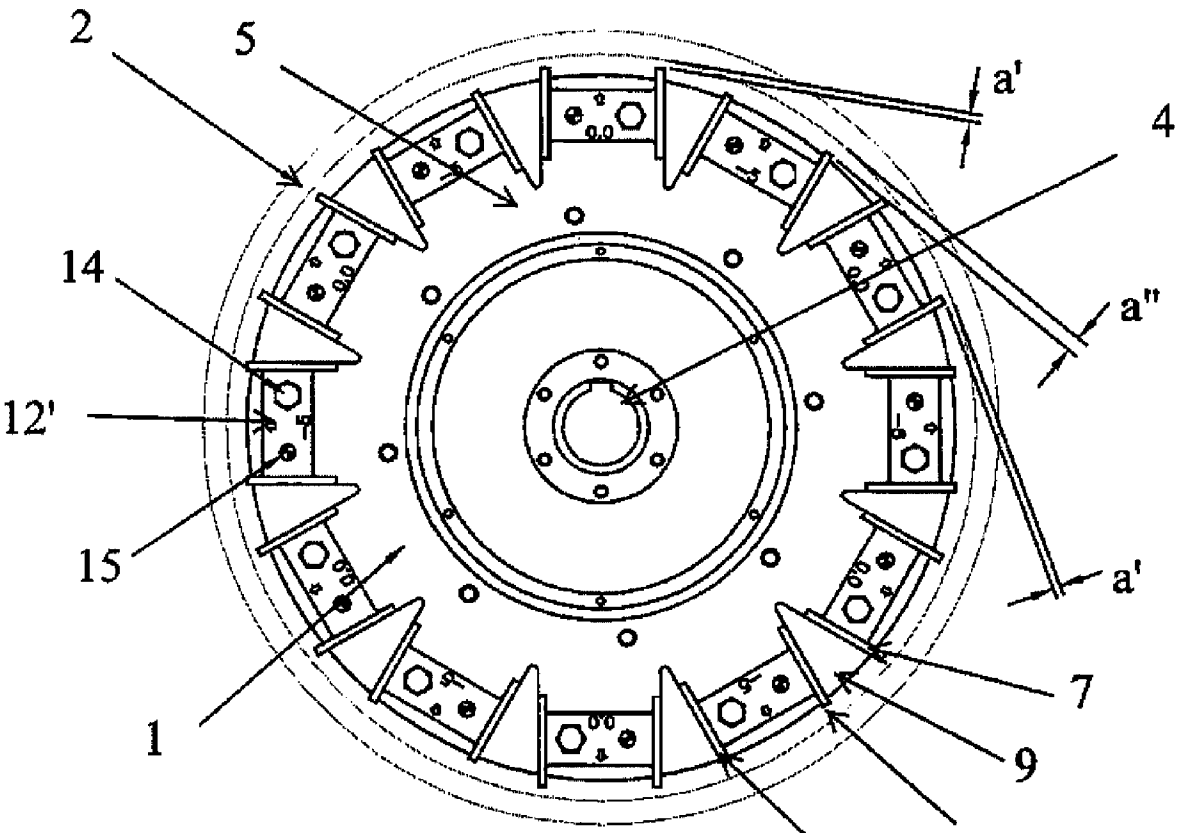
Figure 9B:
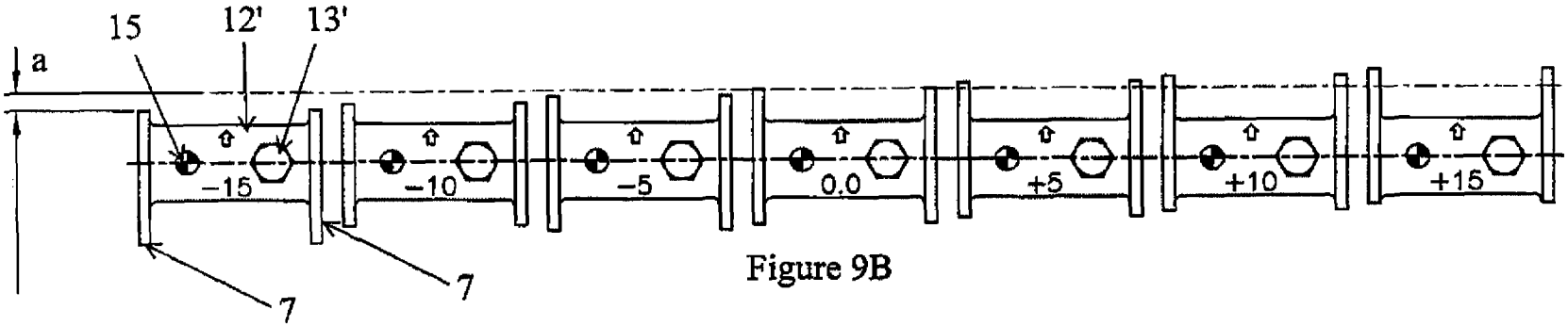

FIG. 2B corresponds to FIG. 2A but with the housing (shown in ghost lines) relocated axially upwards relative to the rotor;

FIG. 3A is an isometric view of a rotor assembly of a conical mill in accordance with the invention at an intermediate stage of mounting of the impact elements;

FIG. 3B is an isometric view of the rotor assembly of FIG. 3A with all of the impact elements mounted;

FIG. 3C is the top view of the rotor assembly of FIG. 3B;

FIG. 4A is an axial cross-section and detail of a rotary assembly of FIG. 3 in which the impact elements are adjustably mounted by means of a slot in the impact element or rotor flange and provide for a narrower grinding gap at the top of the rotor assembly than at the bottom;

FIG. 4B corresponds to FIG. 4A but with the impact elements adjusted to provide the narrower gap at the bottom of the rotor assembly;

FIGS. 5A and 5B correspond to FIGS. 4A and 4B respectively but with adjustment of the impact elements provided by serrated profiles;

FIG. 5C is a top view of the rotary assembly of FIGS. 5A and 5B;

FIGS. 6A and 6B correspond to FIGS. 4A and 4B but with adjustment of the impact elements provided by adjuster screws extending between adjacent impact elements;

FIG. 6C is a top view and detail of the rotary assembly of FIGS. 6A and 6B;

FIG. 7 is the top view of a rotary assembly of a conical mill in accordance with the invention in which the grinding gap provided by a row of impact elements varies in the circumferential direction;

FIGS. 8A, 8B and 8C show impact elements for use in the rotor assembly of FIG. 4;

FIG. 9A is the top view of a rotor assembly of a conical mill in accordance with the invention in which impact elements of one preset radially extending dimension alternate with impact elements of a different preset radially extending dimension; and FIG. 9B shows a set of impact elements of preset sizes for use with the rotor assembly of FIG. 9A.

Figure 1:
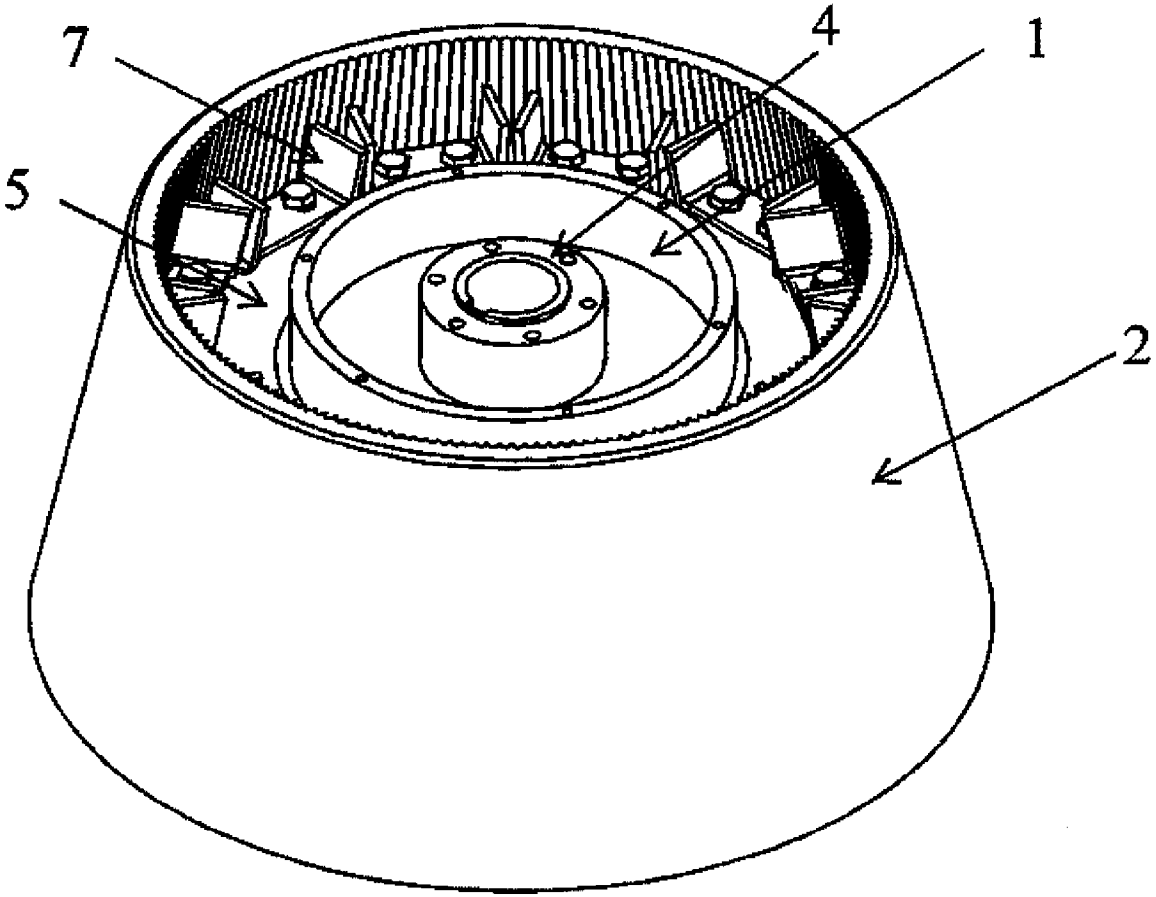
FIG. 1 is an isometric view of a conical impact mill from which, for ease of understanding of the present invention, components other than the rotor, housing and impact elements have been omitted.

As shown in FIGS. 1 and 2, a conventional conical impact mill comprises a rotor assembly 1 rotatably mounted coaxially within a frustoconical housing 2. The rotor assembly comprises a hollow cylindrical rotor 3 having a collar 4 mounted on a shaft (not shown) and axially spaced circumferentially flanges 5, 6 on which are fixedly mounted circumferentially spaced impact elements 7. The impact elements uniformly extend radially from the flanges to define with the grinding surface of the housing an annular grinding gap a of constant radial dimension. One row of impact elements is mounted to extend upwardly from the upper surface of each flange and a second row of impact elements is mounted to depend from bottom surface of each flange. A circumferentially extending flange 8 that does not carry impact elements extends between the depending impact elements of one flange 5 and the upstanding impact elements of the adjacent flange 6.

The grinding gap a can be adjusted by adjusting the housing 1 axially relative to the rotary assembly as shown by comparing FIGS. 2A and 2B but the gap remains both axially and circumferentially constant.

In the embodiments of the invention shown in FIGS. 4, 5 and 6, the impact elements 7 are mounted on the flanges 5, 6 for adjustment b in the radial direction. Their movement is constrained to that direction by circumferentially spaced wedge-shaped profiles 9 on the upper and lower surfaces of the flange. As shown in FIGS. 4A, 4B; 5A, 5B; & 6A, 6B, the radial position of the impact elements can be adjusted so that the grinding gap a' provided by the impact elements on flange 5 is different from that a" provided by the impact elements on flange 6.

In the embodiment of FIG. 4, an adjustment slot is provided in the rotor flange and/or base of the impact element and secured in the required position by a nut and bolt assembly 10. In an alternative arrangement, shown in FIGS. 5A, 5B & 5C, adjustment of the impact elements is provided by a serrated profile 10' permitting of 0.5 mm increments c. In yet another arrangement, shown in FIGS. 6A, 6B & 6C, the adjustment of the impact elements is provided by an adjuster screw assembly 11 that extends between adjacent impact elements and clamps them into abutment with the intervening wedge-shaped profile 9.

Adjustment of the impact elements can provide that the grinding gap a' at the top of the rotor assembly is narrower that that a" at the bottom, as shown in FIGS. 4A, 5A & 6A, or vice versa, as shown in FIGS. 4B, 5B & 6B. Additionally or alternatively, the impact elements can be arranged to provide alternating narrower and wider grinding gaps a' and a" in the circumferential direction of one or more rows as shown in FIG. 7.

As shown in FIG. 8A, the impact elements can be provided in pairs 7*a* & 7*b* connected together by a common base 12 provided with elongate slots 13 facilitating radial adjustment. Additional impact elements 7*c*, 7*d* & 7*e* can be mounted on the same base 12 as shown in FIG. 8B. As shown in FIG. 8C, the impact elements can be inclined at an angle $\alpha$ relative to the axial direction of the rotor.

As shown in FIG. 9, the impact elements can be fixedly located on the flange and variation in the grinding gap provided by the choice of impact elements of differing radial extension as shown in FIG. 9B. In the specific embodiment illustrated in FIG. 9, each pair of impact elements is connected by a common base 12' having a hole 13' through which the element can be attached to the flange by a nut and bolt assembly 14 extending through an aligned hole in the flange. Correct location on the flange is provided by pin 15 on the base engaging a co-operating location hole in the flange or visa versa.

In use, the conical impact mills of the present invention are used in the same manner as the prior art conical impact mills. In particular, they can be used for low temperature, especially cryogenic, comminution to grind, for example, plastics and rubbers. In order to apply the cryogenic fluid, a cooling conveyor is located upstream of the mill and is operated as a closed system, often vacuum jacketed or foam insulated to minimize heat losses, that primarily provides mixing and residence time to effectively lower the temperature of the material to below its Tg. LIN is sprayed directly onto the product within the enclosed cooling conveyor. The flow of LIN to the conveyor is adjusted to maintain a setpoint temperature of material as measured at the conveyor or, in some cases, at another point in the process. Direct cooling within the impact mill itself is not preferred and usually evaporated refrigerant from upstream cooling enters the mill with the feed in order to maintain low temperature and/or to compensate for heating effects associated with comminution. Usually the plastics, rubber or other material to be comminuted will be cooled to below its glass transition temperature to make it brittle and more susceptible to comminution. Commonly, liquid nitrogen is used as the refrigerant but other refrigerants can be used.

It will be appreciated that the invention is not restricted to the details described above with reference to the preferred embodiments but that numerous modifications and variations can be made without departing from the spirit and scope of the invention as defined in the following claims. In particular, the flanged rotor of the illustrated embodiments can be replaced by a rotary assembly in which the flanges are replaced by individual discs mounted on a common shaft. One or more of those discs can be axially adjustable along the shaft to change the respective grinding gap. Similarly, two or more rotors could be provided on a common shaft and one or both could be axially adjustable to change the respective grinding gap. Further, the grinding gap provided by impact elements depending from a disc or flange can be different from that provided by the impact elements upstanding from the same disc or flange. If required, impact elements could extend from only one surface of the disc or flange.

The invention claimed is:

1. A conical impact mill comprising a rotor assembly rotationally mounted in a tubular housing, the tubular housing having a right frustoconical grinding surface coaxially aligned with the rotor assembly, the rotor assembly having at least two axially spaced rows each comprising a plurality of impact elements that are circumferentially spaced and that define an annular grinding gap between the plurality of impact elements and the right frustoconical grinding surface, and the tubular housing having an inlet for a feed to be comminuted in the conical impact mill and an outlet for a comminuted feed, wherein the plurality of impact elements provide, or are adjustable to provide, a radial dimension of the annular grinding gap that is not constant in one or both of an axial dimension and a circumferential direction.

2. A conical impact mill according to claim 1, wherein a first row of the at least two axially spaced rows is axially movable relative to a second row of the at least two axially spaced rows, whereby the radial dimension of the annular grinding gap of the first row of the at least two axially spaced rows can be changed relative to the radial dimension of the annular grinding gap at the second row of the at least two axially spaced rows.

3. A conical impact mill according to claim 2, wherein the radial dimension of the annular grinding gap is not constant in the circumferential direction.

4. A conical impact mill according to claim 1, wherein the radial dimension of the annular grinding gap is constant in the circumferential direction, but the radial dimension of the annular grinding gap at a first row of the at least two axially spaced rows is different than the radial dimension of the annular grinding gap at a second row of the at least two axially spaced rows.

5. A conical impact mill according to claim 1, wherein the radial dimension of the annular grinding gap is not constant in the circumferential direction.

6. A conical impact mill according to claim 5, wherein alternate impact elements of the plurality of impact elements extend to the same radial extent but to a different radial extent than intervening impact elements of the plurality of impact elements, whereby radially narrower grinding gaps alternate with wider grinding gaps.

7. A conical impact mill according to claim 1, wherein at least some of the plurality of impact elements are fixedly located in the rotor assembly.

8. A conical impact mill according to claim 7, wherein the plurality of impact elements in at least a first row of the at least two axially spaced rows are removably secured to a rotor of the rotor assembly for replacement by impact elements of the plurality of impact elements that extend radially from the rotor by a different extent than do the incumbent impact elements of the plurality of impact elements.

9. A conical impact mill according to claim 1, wherein at least some of the plurality of impact elements are movably located in the rotor assembly for adjustment in the radial direction.

10. A conical impact mill according to claim 9, wherein at least some of the plurality of impact elements in said first row are adjustable independently of at least one other impact element of the plurality of impact elements in said first row.

11. A conical impact mill according to claim 1, wherein at least some of the plurality of impact elements in said first row are inclined relative to a plane containing an axis of the rotor.

12. A conical impact mill according to claim 1, wherein the rotor comprises at least one removable radially extending disc or flange on a radially extending surface on which a row of impact elements are mounted.

13. A conical impact mill according to claim 12, wherein the at least one removable disc or flange has a second row of impact elements mounted on an opposed surface, the opposed surface opposing the radially extending surface.

14. A conical impact mill according to claim 1, wherein the annular grinding gap progressively changes row by row of the at least two axially spaced rows in the axial direction between the inlet for the feed to be comminuted and the outlet for the comminuted feed.

15. A method of comminuting material comprising grinding the material in a conical impact mill as defined in claim 1.

* * * * *